US009163492B2

(12) United States Patent
Stiffel et al.

(10) Patent No.: US 9,163,492 B2
(45) Date of Patent: Oct. 20, 2015

(54) METHODS AND SYSTEMS USING A FLUID TREATMENT POLAR GRAPH

(71) Applicant: Halliburton Energy Services, Inc., Duncan, OK (US)

(72) Inventors: Zoltan D. Stiffel, Houston, TX (US); Dwight D Fulton, Cypress, TX (US); Jaynee B Lafferty, Trophy Club, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 127 days.

(21) Appl. No.: 13/658,779

(22) Filed: Oct. 23, 2012

(65) Prior Publication Data

US 2014/0111518 A1 Apr. 24, 2014

(51) Int. Cl.
*G06T 11/20* (2006.01)
*E21B 43/25* (2006.01)

(52) U.S. Cl.
CPC ..... *E21B 43/25* (2013.01)

(58) Field of Classification Search
USPC ..... 345/440; 702/11
See application file for complete search history.

(56) References Cited

U.S. PATENT DOCUMENTS

| | | | | |
|---|---|---|---|---|
| 5,491,779 | A * | 2/1996 | Bezjian | 345/440 |
| 5,559,527 | A * | 9/1996 | Quinn | 455/67.7 |
| 5,619,631 | A * | 4/1997 | Schott | 345/440 |
| 5,798,760 | A * | 8/1998 | Vayda et al. | 715/834 |
| 5,844,572 | A * | 12/1998 | Schott | 345/440 |
| 6,320,586 | B1 * | 11/2001 | Plattner et al. | 715/700 |
| 7,073,581 | B2 | 7/2006 | Fulton et al. | |
| 7,340,347 | B2 * | 3/2008 | Shray et al. | 702/11 |
| 7,460,122 | B1 * | 12/2008 | Smolders et al. | 345/440 |
| 7,543,635 | B2 | 6/2009 | East et al. | |
| 7,692,653 | B1 * | 4/2010 | Petro et al. | 345/440 |
| 8,109,335 | B2 | 2/2012 | Luo et al. | |
| 8,970,599 | B2 * | 3/2015 | Hu et al. | 345/440 |
| 2009/0083666 | A1 * | 3/2009 | Fitzmaurice et al. | 715/834 |

(Continued)

OTHER PUBLICATIONS

Eberhardt, Colin "A WPF Pie Chart with Data Binding Support", <URL:http://www.codeproject.com/Articles/28098/A-WPF-Pie-Chart-with-Data-Binding-Support?display=Print>, (Jul. 24, 2008),12 pgs.

(Continued)

*Primary Examiner* — M Good Johnson
(74) *Attorney, Agent, or Firm* — Krueger Iselin LLP; Holly Soehnge

(57) ABSTRACT

Downhole fluid treatment planning systems and methods should enable efficient creation, review, and editing of downhole fluid treatment plans. In some of the disclosed embodiments, a downhole fluid treatment planning method includes receiving downhole environment information. The method also includes generating a polar graph with multiple stage type wedges to visually represent fluid coverages or volumes of a downhole fluid treatment plan based on the downhole environment information. Meanwhile, a system for downhole fluid treatment planning includes a memory having software and an output device. The system also includes a processor coupled to the memory to execute the software. The software configures the processor to receive downhole environment information and to output a polar graph. The polar graph includes multiple stage type wedges to visually represent fluid coverages or volumes of a downhole fluid treatment plan based on the downhole environment information.

20 Claims, 7 Drawing Sheets

(56) References Cited

U.S. PATENT DOCUMENTS

| | | | | |
|---|---|---|---|---|
| 2009/0125280 | A1 | 5/2009 | Soliman et al. | |
| 2009/0182693 | A1 | 7/2009 | Fulton et al. | |
| 2009/0229819 | A1* | 9/2009 | Repin et al. | 166/250.01 |
| 2010/0131881 | A1* | 5/2010 | Ganesh | 715/769 |
| 2010/0155058 | A1 | 6/2010 | Gordy et al. | |
| 2010/0200235 | A1 | 8/2010 | Luo et al. | |
| 2010/0212906 | A1 | 8/2010 | Fulton et al. | |
| 2011/0164055 | A1* | 7/2011 | McCullough et al. | 345/642 |
| 2012/0041990 | A1* | 2/2012 | Kreindlina et al. | 707/805 |
| 2012/0191432 | A1* | 7/2012 | Khataniar et al. | 703/10 |
| 2012/0214715 | A1 | 8/2012 | Luo et al. | |

OTHER PUBLICATIONS

McCandless, David "The Visual Miscellaneum", HarperCollinsPublishers, 1st U.S. Edition, (2009),p. 128.

"Roambi", <URL:http://www.roambi.com/roambi_on_ipad.html>, 1 pg.

* cited by examiner

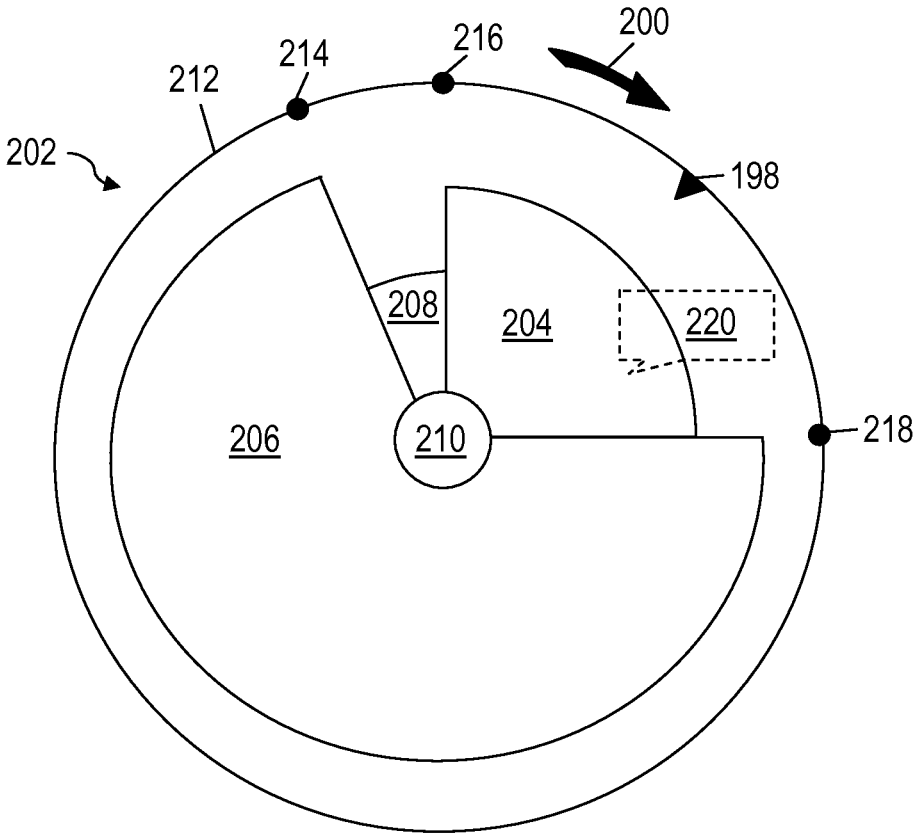
FIG. 2
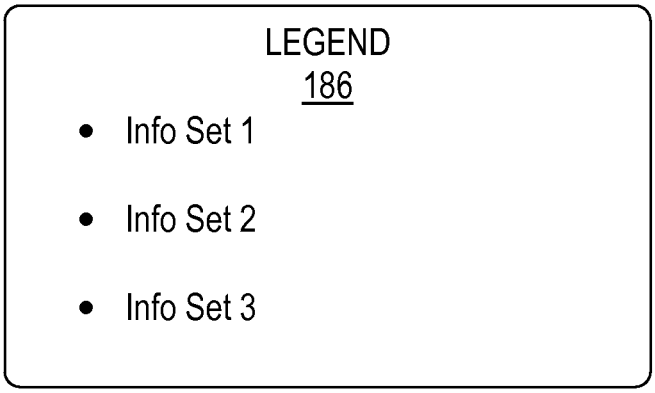

METHODS AND SYSTEMS USING A FLUID TREATMENT POLAR GRAPH

BACKGROUND

After a wellbore has been drilled, the wellbore typically is cased by inserting lengths of steel pipe ("casing sections") connected end-to-end into the wellbore. Threaded exterior rings called couplings or collars are typically used to connect adjacent ends of the casing sections at casing joints. The result is a "casing string" including casing sections and connecting collars that extends from the surface to a bottom of the wellbore. The casing string is then cemented in place to complete the casing operation. Well completion is then achieved by perforating the casing to provide access to one or more desired formations, e.g., to enable fluid from the formation(s) to enter the wellbore.

Hydraulic fracturing is an operating technique where a fracturing fluid, typically water with selected additives, is pumped into a completed well under high pressure. The high pressure fluid causes fractures to form and propagate within the surrounding geological formation, making it easier for formation fluids to reach the wellbore. After the fracturing is complete, the pressure is reduced, allowing most of the fracturing fluid to flow back into the well. Some residual amount of the fracturing fluid may be expected to remain in the surrounding formation and perhaps flow back to the well over time as other fluids are produced from the formation.

In addition to or as part of hydraulic fracturing processes, stimulation treatments may be considered. In the stimulation planning process (e.g., for fracturing treatments or matrix acidizing treatments), the goal is to determine the appropriate fluids, and the attributes of those fluids, for optimal stimulation of a wellbore. Costs of treatments also may be taken into account. During the stimulation planning process, multiple treatment stages, stage types, and fluids may be considered. Stage types, stage fluids, volumes, or other parameters, may be determined manually, or may result from a recommendation engine or algorithm. In either case, the resulting fluid selection information may be displayed for viewing and evaluation.

Information such as treatment fluid type, stage type, stage data, etc., is typically presented in a simple tabular form. However, for complex treatment job designs, a tabular presentation requires detailed review to comprehend. Existing techniques to determine and convey information for stimulation treatment planning are inefficient.

BRIEF DESCRIPTION OF THE DRAWINGS

Accordingly, there are disclosed herein methods and systems using a fluid treatment polar graph. In the drawings:

FIG. 2 is an illustrative diagram of polar graph features.

The drawings show illustrative embodiments that will be described in detail. However, the description and accompanying drawings are not intended to limit the invention to the illustrative embodiments, but to the contrary, the intention is to disclose and protect all modifications, equivalents, and alternatives falling within the scope of the appended claims.

NOMENCLATURE

Certain terms are used throughout the following description and claims to refer to particular system components. This document does not intend to distinguish between components that differ in name but not function. The terms "including" and "comprising" are used in an open-ended fashion, and thus should be interpreted to mean "including, but not limited to . . . ".

The term "couple" or "couples" is intended to mean either an indirect or direct electrical, mechanical, or thermal connection. Thus, if a first device couples to a second device, that connection may be through a direct connection, or through an indirect connection via other devices and connections. Conversely, the term "connected" when unqualified should be interpreted to mean a direct connection. For an electrical connection, this term means that two elements are attached via an electrical path having essentially zero impedance.

DETAILED DESCRIPTION

Disclosed herein are systems and methods that employ fluid treatment polar graphs. The disclosed polar graphs may be used to visualize fluid treatment stage types and related fluid volumetrics coverage of treatment fluid over a reservoir interval. Further, the disclosed polar graphs may convey information regarding the order of treatment stage types, the effectiveness of fluid treatments, the cost of fluid treatments, or other details. In some embodiments, a treatment option interface and stage type details may be displayed with a corresponding polar graph to facilitate polar graph updates and review of treatment details. Further, a polar graph may be interactive (e.g., to enable treatment plan editing and/or selective display of information). Further, new treatments plans may be based on selection or modification of pre-existing polar graph templates.

Figure 1:
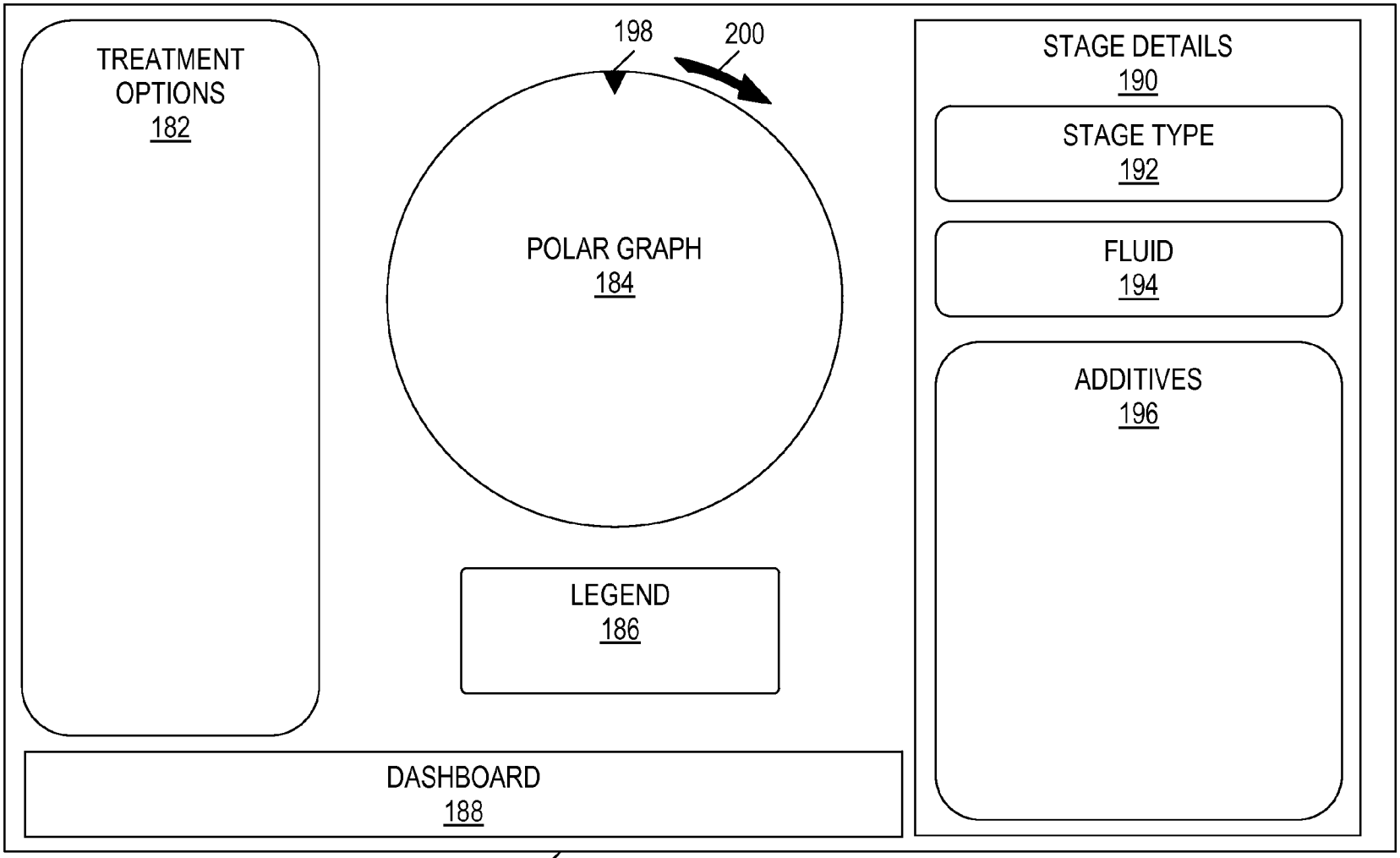
FIG. 1 is an illustrative screenshot related to downhole fluid treatment planning software.

FIG. 1 is an illustrative screenshot 180 related to downhole fluid treatment planning software. In screenshot 180, a polar graph 184 may display information regarding treatment stage types and their fluid coverage as described herein. The term "coverage" as used herein refers to the amount, or volume, of treatment fluid to be applied per unit of reservoir interval length in a wellbore. Coverage and volume, while two different physical quantities, both represent the amount of treatment fluid recommended or otherwise specified. A marker 198 may move around the polar graph to indicate which of multiple stage types in the polar graph 184 has been selected for review. Further, directional marker 200 may indicate a direction of progression through the stage types of the polar graph 184 (e.g., the directional marker 200 may start at the first preflush stage type). Further, a legend 186 is displayed to facilitate interpretation of the polar graph as described herein.

To facilitate review and editing of a fluid treatment plan, a treatment options window 182 is provided with selectable options and a polar graph refresh function as described herein. Further, a stage details window 190 may be presented or filled with information upon selection of a particular stage type wedge of the polar graph 184. Without limitation, the stage details window 190 may include a stage type section 192, a fluid section 194, and an additives section 196. To enable quick access to particular features of the fluid treatment planning software related to screenshot 180, a dashboard 188 is displayed with selectable icons as described herein.

FIG. 2 is an illustrative diagram 202 of polar graph features. Without limitation, the polar graph features of diagram 202 may correspond to the polar graph 184 and the legend 186 of screenshot 180. In diagram 202, three stage types 204, 206, and 208 are represented. Stage type 204 may be a preflush stage, while stage type 206 corresponds to a mainflush stage type and stage type 208 corresponds to an overflush stage type. As shown, the wedge angle size of stage type 208 is smallest, while the wedge angle size of stage type 206 is largest (the wedge angle size of stage type 204 is larger than that of stage type 208 and is smaller than that of stage type 206). When combined, the wedge angles of stage types 204, 206, 208 form a completed circular shape (360 degrees) and represent all of the fluids related to the fluid treatment plan represented by diagram 202. The radius size of stage type 206 is largest and represents a specific coverage and/or volume value (e.g., a radius of 2 inches corresponds to 300 gal/ft). Although not required, the coverage and/or volume value may be normalized. Similarly, the radius sizes of stage types 204 and 208 represent specific coverage and/or volume values stage type 208 having the smaller radius size and the smallest corresponding coverage and/or volume value. Although the radius for each stage type 204, 206, and 208 is shown to be constant, linear or non-linear fluid coverage and/or volume operations could be employed during each stage type and could be represented by varying the radius accordingly.

In the diagram 202, various other polar graph features are also represented. For example, a polar graph ring 212 surrounds stage types 204, 206, and 208. The polar graph ring 212 may include separators 214, 216, and 218 to help define stage type boundaries. The arcs between the different separators may be colored to match the stage types 204, 206, 208 (e.g., the line between separate 214 and 216 is colored to match the color of its corresponding stage type 208, and so on). In particular, the polar graph ring 212 is helpful when a particular stage type is very small and is otherwise difficult to view/select. The diagram 202 also shows a marker 198 representing a selection of stage type 204 for review (e.g., treatment options and stage details are viewable when a given stage type is selected). Further, directional arrow 200 shows a direction of progression (stage type 204 is first, then stage type 206, and finally stage type 208). Without limitation, a total, material, and/or volume score interface 210 may be positioned at the center of the polar graph of diagram 202 to indicate a score for the treatment plan represented by the polar graph. Further, a legend 186 for the polar graph of diagram 202 may be displayed. The legend 186 may include information sets for stage types 204, 206, 208.

The stage types 204, 206, or 208 may include a portion of the wedge-shaped graphic which is shaded or otherwise visually distinguished from the rest of the graphic. This shaded area may then represent another quantity relative to that particular stage type, including but not limited to a measure of sub-optimization. That is, if the fluid or its coverage and/or volume amount chosen or recommended for that stage type does not correlate to the highest material or volume score possible, then it could be deduced that the fluid or coverage and/or volume is sub-optimal. The amount to which this can be quantified is shown by a visually distinguished portion of the stage type graphic.

The polar graph features of FIGS. 1 and 2 may be utilized with downhole fluid treatment planning software. More specifically, downhole environment information may be received and is used to generate a preliminary fluid treatment plan. Alternatively, a user may review available polar graph templates to select a preliminary fluid treatment plan. The polar graph visually represents stage types and fluid coverages and/or volumes of the preliminary fluid treatment plan. A user may subsequently update the preliminary fluid treatment plan by selecting from or entering values for various treatment plan options. An updated polar graph may be created and reviewed for each updated fluid treatment plan until a suitable plan has been found. During the update process, an interactive polar graph may enable to user to dynamically adjust a fluid treatment plan as described herein until a suitable plan has been found.

Without limitation, the polar graph features described herein may be utilized as part of a sales tool to facilitate discussion between a vendor and a client. As an example, the vendor may receive a request from or initiate discussion with a client to provide fluid treatment plan services or products. In response, the vendor may use fluid treatment planning software to review fluid treatment plan options, option costs, and option effectiveness. To select a fluid treatment plan, the vendor may receive information from the client regarding the downhole environment (e.g., wellbore dimensions or formation layer information) to be treated. During the discussion, the polar graph features described herein may be used to visualize and explain fluid treatment plan options. Further, the polar graph features may be used to explain and visualize differences between different fluid treatment plan options.

Figure 3:
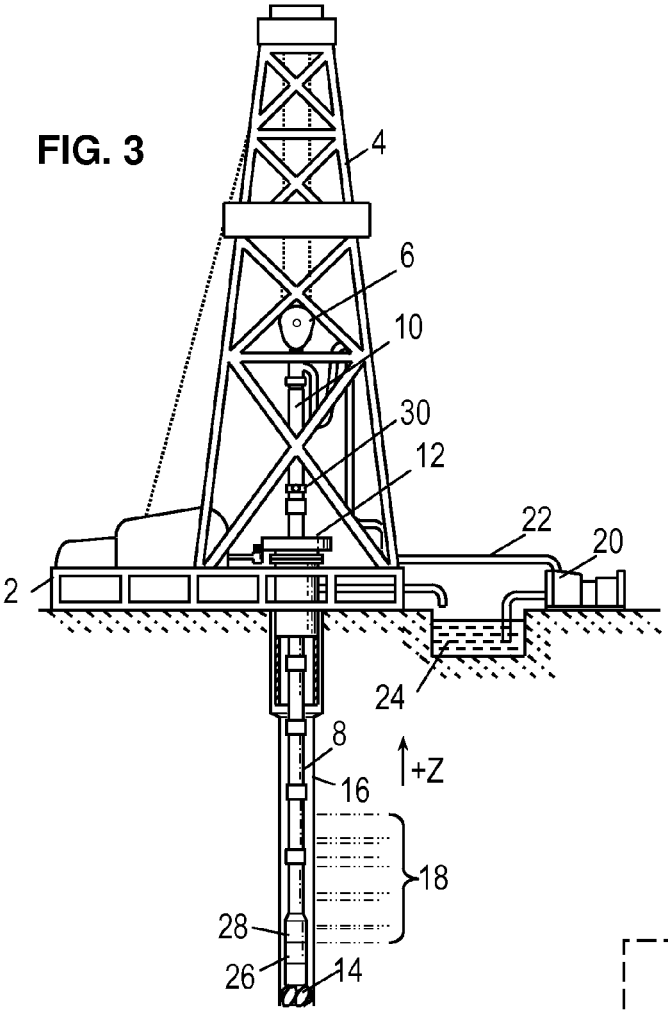
FIG. 3 shows an illustrative logging while drilling (LWD) environment.

The disclosed systems and methods for utilizing treatment plan polar graphs may be based, in part, on the collection of downhole environment data. FIG. 3 shows an illustrative logging while drilling (LWD) environment. A drilling platform 2 supports a derrick 4 having a traveling block 6 for raising and lowering a drill string 8. A drill string kelly 10 supports the rest of the drill string 8 as it is lowered through a rotary table 12. The rotary table 12 rotates the drill string, thereby turning a drill bit 14. As bit 14 rotates, it creates a borehole 16 that passes through various formations 18. A pump 20 circulates drilling fluid through a feed pipe 22 to kelly 10, downhole through the interior of drill string 8, through orifices in drill bit 14, back to the surface via the annulus around drill string 8, and into a retention pit 24. The drilling fluid transports cuttings from the borehole into the pit 24 and aids in maintaining the borehole integrity.

The drill bit 14 is just one piece of a bottom-hole assembly that includes one or more drill collars (thick-walled steel pipe) to provide weight and rigidity to aid the drilling process. Some of these drill collars include built-in logging instruments to gather measurements of various drilling parameters such as position, orientation, weight-on-bit, borehole diameter, etc. An azimuthally sensitive tool 26 (such as a pulsed neutron logging tool, a gamma ray logging tool, an acoustic logging tool, or a resistivity logging tool) may be integrated into the bottom-hole assembly near the bit 14. In such case, tool 26 may rotate and collect azimuthally-sensitive formation property measurements. The measurements can be stored in internal memory and/or communicated to the surface. A telemetry sub 28 may be included in the bottom-hole assembly to maintain a communications link with the surface. Mud pulse telemetry is one common telemetry technique for transferring tool measurements to surface receivers 30 and receiving commands from the surface, but other telemetry techniques can also be used.

Figure 4:
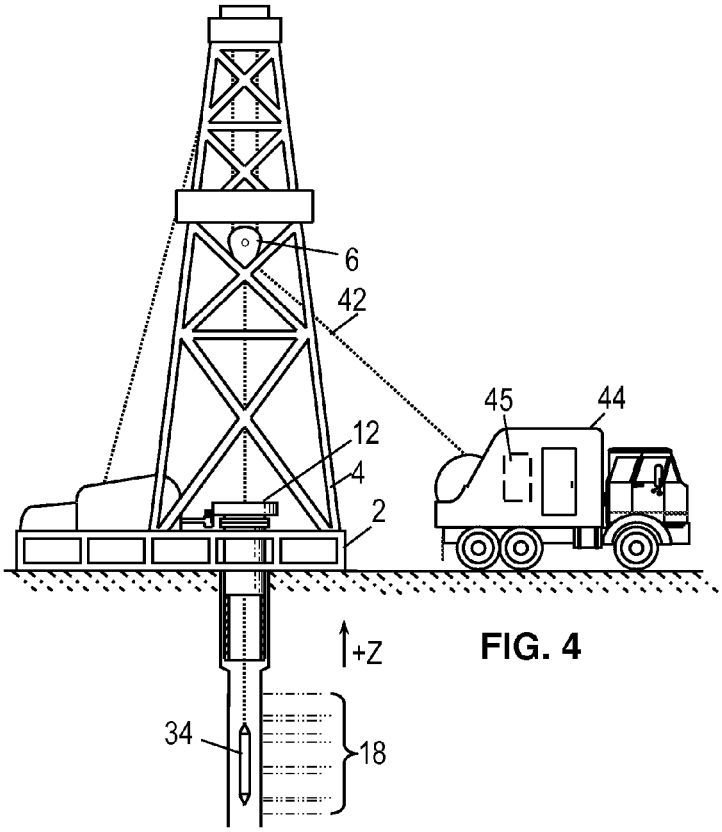
FIG. 4 shows an illustrative wireline logging environment.

At various times during the drilling process, the drill string 8 may be removed from the borehole as shown in FIG. 4. Once the drill string has been removed, logging operations can be conducted using a wireline logging tool 34, i.e., a sensing instrument sonde suspended by a cable 42 having conductors for transporting power to the tool and telemetry from the tool to the surface. It should be noted that various types of formation property sensors can be included with the wireless logging tool 34. A logging facility 44 collects measurements from the logging tool 34, and includes computing facilities 45 for processing and storing the measurements gathered by the logging tool 34. For the logging environments of FIGS. 3 and 4, measured parameters are usually recorded and displayed in the form of a log, i.e., a two-dimensional graph showing the measured parameter as a function of tool position or depth. In addition to making parameter measurements as a function of depth, some logging tools also provide parameter measurements as a function of rotational angle.

Figure 5:
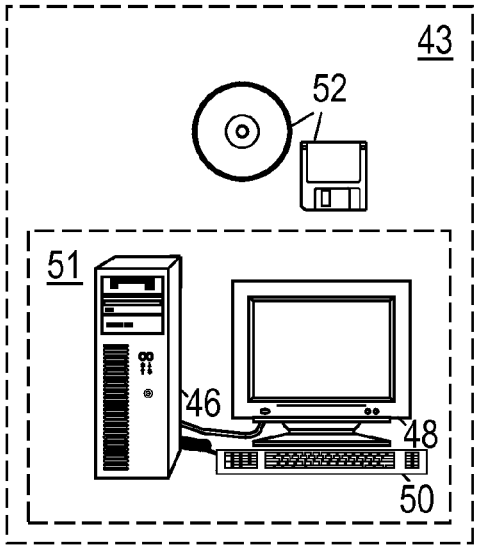
FIG. 5 shows an illustrative computer system for storing and processing downhole environment information.

FIG. 5 shows an illustrative computer system 43 for storing and/or processing downhole environment information. The computer system 43 may correspond to the computing facilities 45 of logging facility 44 or another computing system that receives logging data. The computer system 43 may include wired or wireless communication interfaces for receiving logging data during a logging process, or thereafter.

As shown, computer system 43 includes user workstation 51 with a general processing system 46. The general processing system 46 is configured by software, shown in FIG. 3 in the form of removable, non-transitory (i.e., non-volatile) information storage media 52, to collect and process downhole environment information for downhole fluid treatment planning. The software may also be downloadable software accessed through a network (e.g., via the Internet). As shown, general processing system 46 may couple to a display device 48 and a user-input device 50 to enable a human operator to interact with system software stored by computer-readable media 52.

Software executing on the user workstation 51 may present downhole environment information to the user of downhole fluid treatment planning software. In some embodiments, the user may manually enter or modify downhole environment information for use by downhole fluid treatment planning software via a suitable user interface. Additionally or alternatively, downhole fluid treatment planning software may automatically receive or retrieve downhole environment information from the software executing on user workstation 51.

Figure 6:
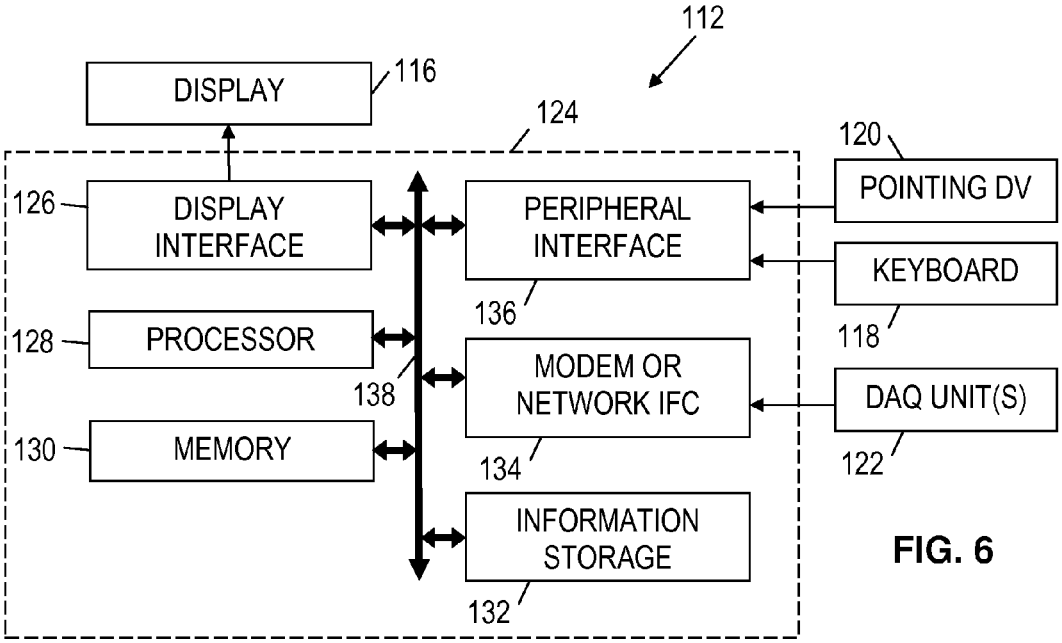
FIG. 6 is a block diagram of illustrative computer system for downhole fluid treatment planning.

FIG. 6 is a block diagram of illustrative computer system 112 for downhole fluid treatment planning. The computer system 112 may correspond to user workstation 51 or another computer. In FIG. 4, the computer system 112 comprises a display 116, a keyboard 118, a pointing device 120 and a data acquisition unit 122 coupled to computer chassis 124. Keyboard 118 and pointing device 120 are just two examples of the many suitable input devices available to the user for guiding the system's operation in response to information provided on display 116. Data acquisition unit 122 serves as an optional way to acquire downhole environment information from a logging tool or other source.

Located in the chassis 124 are display interface 126, peripheral interface 136, bus 138, processor 128, memory 130, information storage device 132, and network interface 134. The display interface 126 may take the form of a video card or other suitable interface that accepts information from the bus 138 and transforms it into a form suitable for display 116. Conversely, the peripheral interface 136 may accept signals from input devices 118, 120 and transform them into a form suitable for communication on bus 138. Bus 138 interconnects the various elements of the computer and transports their communications.

Processor 128 gathers information from the other system elements, including input data from the peripheral interface 136 and program instructions and other data from the memory 130, the information storage device 132, or from an external location via the network interface 134. (The network interface 134 enables the processor 128 to communicate with remote systems via a wired or wireless network.) The processor 128 carries out the program instructions and processes data accordingly. The program instructions may further configure the processor 128 to send data to other system elements, including information for the user, which may be communicated via the display interface 126 and the display 116.

The processor 128, and hence the computer as a whole, generally operates in accordance with one or more programs stored on an information storage device 132. One or more of the information storage devices may store programs and data on removable storage media (such as a computer-readable media 52 of FIG. 3). Whether or not the information storage media is removable, the processor 128 may copy portions of the programs into the memory 130 for faster access, and may switch between programs or carry out additional programs in response to user actuation of the input device. One or more of these programs configures the computer to carry out at least one of the downhole fluid treatment planning methods disclosed herein.

Stated in another fashion, the methods described herein can be implemented in the form of software that can be communicated to a computer or another processing system on an information storage medium such as an optical disk, a magnetic disk, a flash memory, or other persistent storage device. Alternatively, such software may be communicated to the computer or processing system via a network or other information transport medium. The software may be provided in various forms, including interpretable "source code" form and executable "compiled" form. The various operations carried out by the software as described herein may be written as individual functional modules (e.g., "objects", functions, or subroutines) within the source code.

Figure 7:
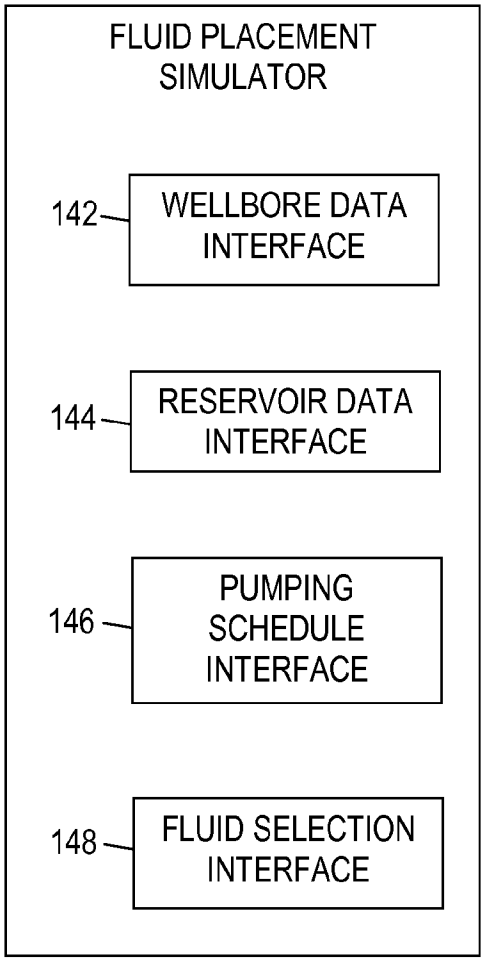
FIG. 7 is a block diagram of an illustrative fluid placement simulator program.

FIG. 7 is a block diagram of an illustrative fluid placement simulator program 140. In some embodiments, the fluid placement simulator program 140 implements a fluid selection interface 148 that generates and displays fluid treatment polar graphs as described herein. In addition, the fluid placement simulator program 140 includes a wellbore data interface 142 that operates to receive or retrieve wellbore data periodically or upon request. Additionally or alternatively, the wellbore data interface 142 may enable a user to manually enter or modify wellbore information such as its dimensions. The fluid placement simulator program 140 also includes a reservoir data interface 144 that operates to receive or retrieve reservoir data periodically or upon request. Additionally or alternatively, the reservoir data interface 142 may enable a user to manually enter or modify reservoir data such as formation layer information. The fluid placement simulator program 140 also includes a pumping schedule interface 146 that operates to receive or retrieve pumping schedule instructions periodically or upon request. Additionally or alternatively, the pumping schedule interface 146 may enable a user to manually enter or modify a pumping schedule.

Figure 8:
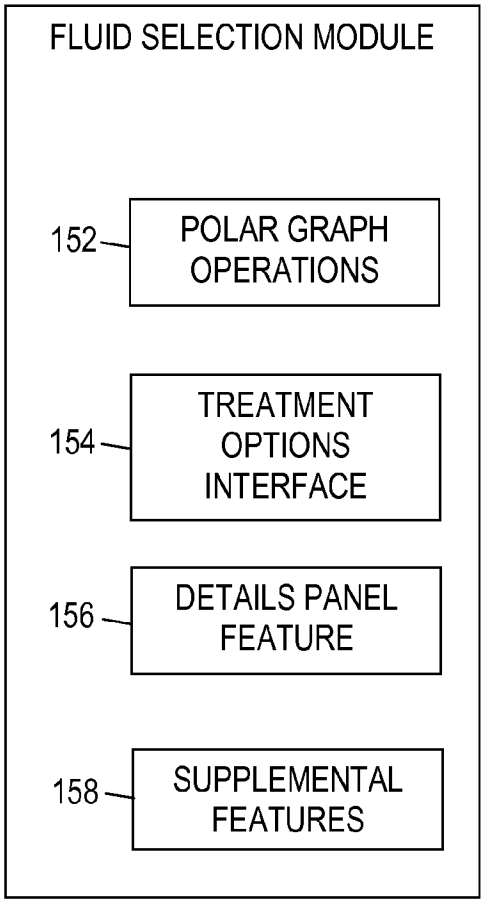
FIG. 8 is a block diagram of an illustrative fluid selection module.

FIG. 8 is a block diagram of an illustrative fluid selection module 150. The fluid selection module 150 may correspond to the fluid selection interface 148 of the fluid placement simulator 140 or may correspond to another program that utilizes polar graphs to convey information regarding downhole fluid treatment planning. As shown, the fluid selection module 150 comprises polar graph operations 152, a treatment options interface 152, a details panel feature 156, and supplemental features 158.

The polar graph operations 152 generate a polar graph that represents stage types of a downhole fluid treatment plan. The polar graph operations may be based on downhole environment information and/or a pumping schedule that was previously received or retrieved by the fluid selection module 150. Additionally or alternatively, the downhole environment information and/or pumping schedule may be entered or modified manually by a user. Without limitation to other examples, such downhole environment information may include wellbore dimensions, wellbore fluids, reservoir layer types and locations. Meanwhile, the pumping schedule may correspond to fluid volumes and time criteria that vary for different pumping mechanisms and treatments.

When executed, the polar graph operations 152 generate information for a polar graph with multiple stage type wedges to visually represent fluid coverages and/or volumes of a downhole fluid treatment plan based on the downhole environment information and/or the pumping schedule. To generate a polar graph, the polar graph operations 152 may determine a wedge angle size for each of the multiple stage type wedges of the polar graph, where each of the wedge angle sizes represents a percentage of total fluid coverage and/or volume for the fluid treatment plan. Although not required, the combination of the stage type wedges may complete a circular pattern (360 degrees), which represents all of the fluid coverage and/or volume related to a fluid treatment plan. Further, the polar graph operations 152 may determine a wedge radius size for each of the multiple stage type wedges, where each of the wedge radius sizes represents a coverage and/or volume value (e.g., 2 inches may correspond to 300 gal/ft). Thus, different stage type wedges may have different radii while wrapping around to complete a circle as will be described in greater detail for FIG. 9. Further, the polar graph operations 152 may determine a color for each of the multiple stage type wedges of a polar graph, where each of the wedge colors represents treatment highlights or other information about the stage type.

The treatment options interface 154 enables a user to select from predetermined treatment options which would impact the recommended stage type, fluid type, or coverage. In response to selecting or adjusting one or more of the treatment options supported by the treatment options interface 154, an updated polar graph can be generated and displayed.

The details panel feature 156 enables presentation of stage details related to a polar graph. As an example, the stage details may appear in response to a user clicking on or moving a cursor over a stage type wedge of a generated polar graph. Without limitation to other examples, the stage details may include stage type information (e.g., preflush, mainflush, overflush), fluid information (e.g., acid name or type), and additives information (e.g., clay stabilizer, mutual solvent, penetrating agent, corrosion inhibitor). Also, scores for the stage type, stage fluid, and additives may be displayed to facilitate comparison between different options.

The supplemental features 158 enable various supplemental features related to fluid treatment polar graphs. For example, the supplemental features 158 may correspond to providing a polar graph legend that identifies a color and treatment highlights (e.g., stage type, fluid name, fluid coverage and/or volume) or other information for each of the multiple stage type wedges of a polar graph. Additionally or alternatively, the supplemental features 158 may correspond to calculating and displaying a total score (total, material, and/or volume score) for a fluid treatment plan related to a polar graph. Without limitation, the total, material, and/or volume score may be displayed in the center of the polar graph. Additionally or alternatively, the supplemental features 158 may correspond to polar graph ring functions, a directional indicator, or other visual tools around the polar graph. The polar graph ring may be color coded to match the stage type wedges and may indicate (e.g., using an arrow, carat, or marker) when a particular stage type is selected. Additionally or alternatively, the supplemental features 158 may correspond to dashboard icons and functions related to injection options, oil options, sour options, surface options, bottom options, damage options, mineralogy options, formation options, instability options, mode options, clone options, or customization options.

In some embodiments, the supplemental features 158 may correspond to polar graph editing options (e.g., support for dragging operations on stage type wedges of the polar graph, and displaying an updated materials score as the polar graph is updated). An edit treatment interface for polar graphs such as wedge boundary dragging operations may result in dynamic updates to dimensions and colors of a polar graph and its associated total, material, and/or volume score. Further, color shading and/or transparency may be used to compare two polar graphs or to show edits to a polar graph. Additionally or alternatively, the supplemental features 158 may correspond to displaying a semi-transparent stage type information bubble or tooltip (e.g., with fluid information and coverage and/or volume information) as a cursor passes over a stage type wedge of the polar graph. Additionally or alternatively, the supplemental features 158 may correspond to a new treatment interface option that enables a new polar graph to be generated based on selection or modification of polar graph templates.

Figure 9:
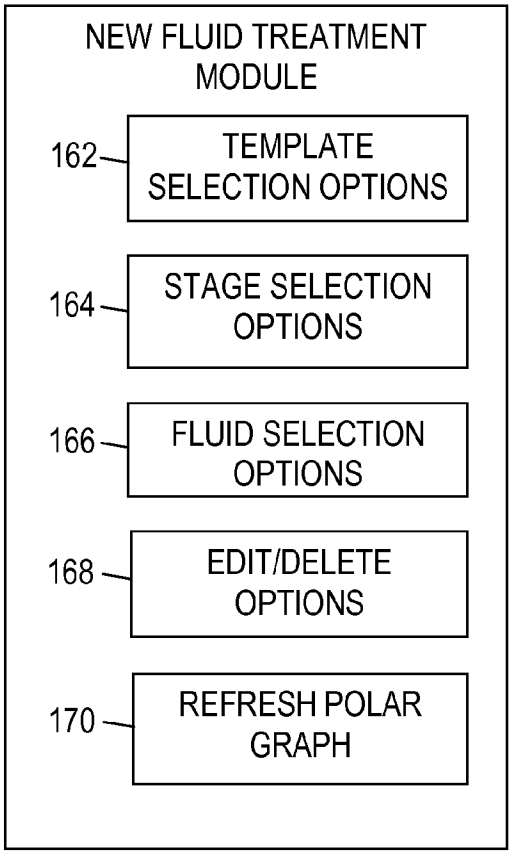
FIG. 9 is a block diagram of an illustrative new fluid treatment module.

FIG. 9 is a block diagram of an illustrative new fluid treatment module 160. As shown, the new fluid treatment module 160 comprises template selection options 162, stage type selection options 164, fluid selection options 166, edit/delete options 168, and a refresh polar graph feature 170. In operation, the template selection options 162 enable a user to select a new fluid treatment plan by selecting or modifying available polar graph templates. Further, the stage type selection options 164 enable a user to develop a new fluid treatment plan by selecting or modifying available preflush stage type options, mainflush stage type options, and overflush stage type options. Further, the fluid selection options 166 enable a user to develop a new fluid treatment plan by selecting or modifying available fluids for preflush, mainflush, or overflush stage types. The edit/delete options 168 enable a user to edit or delete stage types, fluids, or other selections being made during new treatment planning. The refresh polar graph feature 170 enables a user to request generation and display of a polar graph in order to visualize the effect of options being selected or de-selected during new treatment planning.

Figure 10:
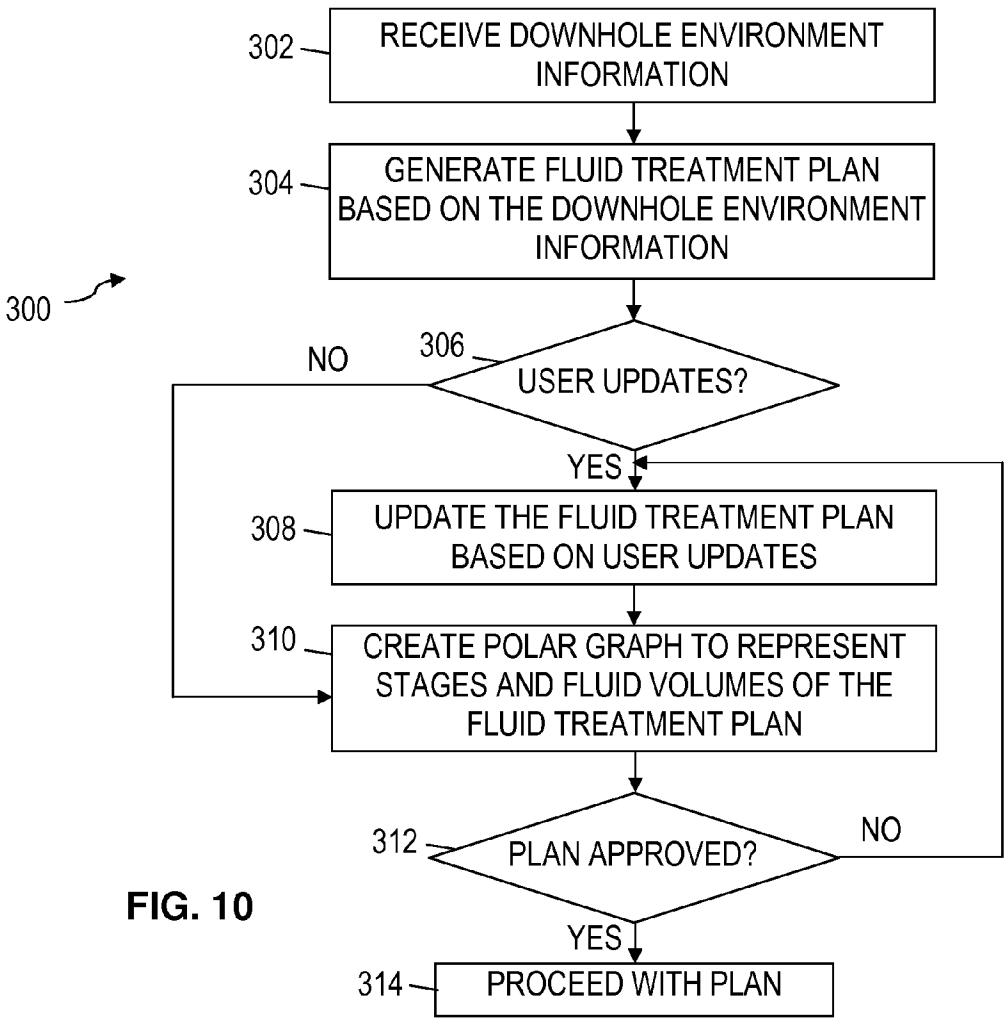
FIG. 10 is an illustrative flowchart of a downhole fluid treatment planning method.

FIG. 10 is an illustrative flowchart of a downhole fluid treatment planning method 300. The method 300 may be performed by a computer system as explained herein. As shown, the method 300 comprises receiving downhole environment information at block 302. At block 304, a fluid treatment plan is generated based on the downhole environment information. If user updates are applied (determination block 306), the fluid treatment plan is updated based on user updates (block 308). At block 310, a polar graph is created to represent stage types and fluid coverages and/or volumes of the fluid treatment plan generated at block 304 or the updated fluid treatment plan generated at block 308. If the plan represented by the polar graph created at block 310 is approved (determination block 312), the method 300 proceed with that plan at block 314. If the plan represented by the polar graph created at block 310 is not approved (determination block 312), the method 300 returns to block 308.

Figure 11:
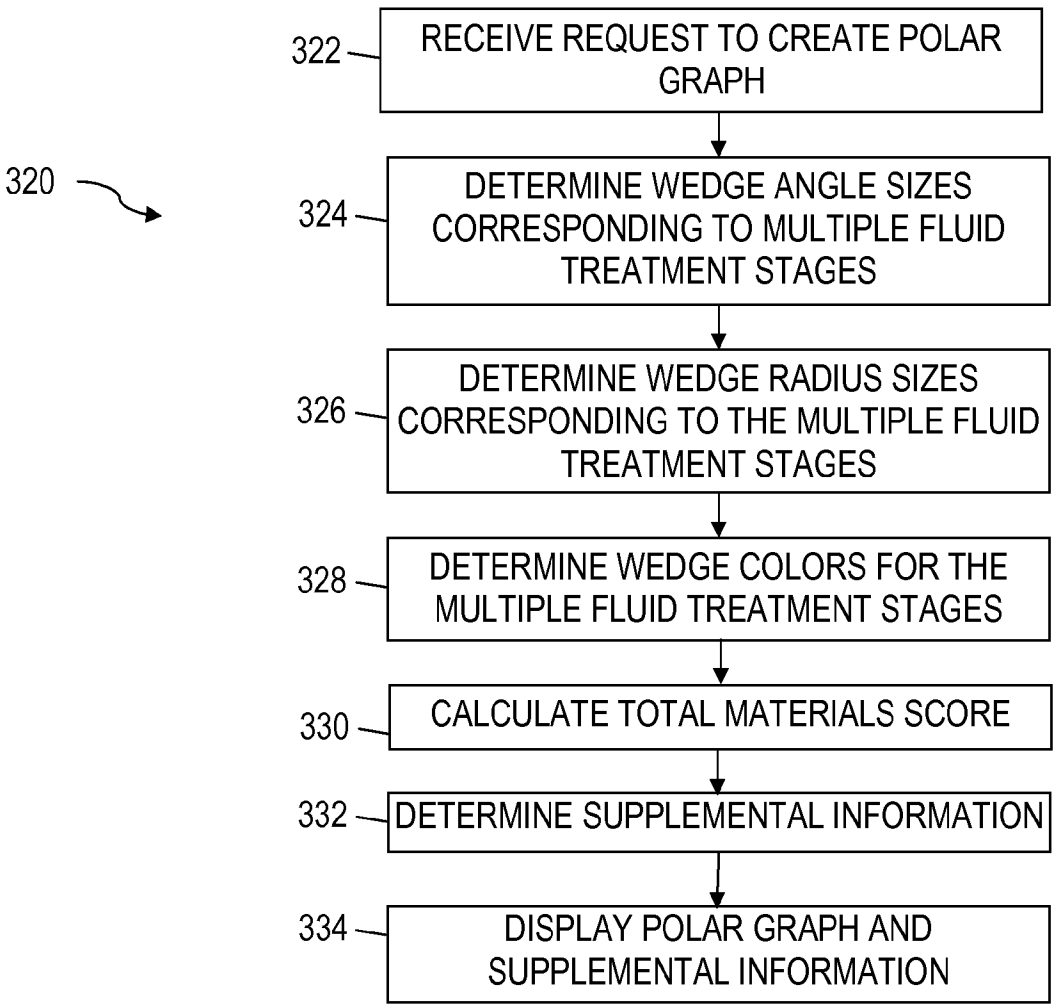
FIG. 11 is an illustrative flowchart for a polar graph creation method.

FIG. 11 is an illustrative flowchart of a polar graph creation method 320. As shown, the method 320 comprises receiving a request to create a polar graph at block 322. The request of block 320 may be part of downhole fluid treatment planning method 300 or another method that creates a fluid treatment polar graph. At block 324, wedge angle sizes corresponding to multiple fluid treatment stage types are determined. The wedge angle sizes may correspond to a percentage of total coverage and/or volume for a fluid treatment plan as described herein. Further, wedge radius sizes corresponding to the multiple fluid treatment stage types are determined at block 326. The wedge radius sizes may correspond to a fluid coverage and/or volume value as described herein. At block 328, wedge colors for multiple fluid treatment stage types are determined. The wedge colors may correspond to a specific stage type. Further, a total materials score for a fluid treatment plan is calculated at block 330, and supplemental information is determined at block 332.

The supplemental information may correspond to treatment options features, stage detail features, dashboard features, legend features, polar graph ring details, directional arrow information, stage type selection marker features, polar graph editing features, polar graph template features, polar graph ring features, selected stage type marker features, and/or stage type pop-up bubble features as described herein. At block 334, a polar graph is displayed with supplemental information. Some supplemental information may appear in response to a cursor moving over a particular feature of a polar graph or in response to another selection mechanism. The displayed polar graph of block 334 may be based on the wedge angle sizes determined at block 324, the wedge radius sizes determined at block 326, and the wedge colors determine at block 328. Further, the displayed polar graph of block 334 may be based on downhole environment information and/or may represent a previously generated fluid treatment plan The supplemental information related to the polar graph displayed at block 334 may include, for example, a total, material, and/or volume score, treatment option features, stage detail features, dashboard features, legend features, polar graph ring details, directional arrow information, stage type selection marker features, polar graph editing features, polar graph template features, polar graph ring features, selected stage type marker features, and/or stage type pop-up bubble features as described herein.

Numerous variations and modifications will become apparent to those skilled in the art once the above disclosure is fully appreciated. For example, though the methods disclosed herein have been shown and described in a sequential fashion, at least some of the various illustrated operations may occur concurrently or in a different sequence, with possible repetition. It is intended that the following claims be interpreted to embrace all such variations, equivalents, and modifications.

What is claimed is:

1. A downhole fluid treatment planning method that comprises:

receiving downhole environment information; and generating a downhole fluid treatment plan based on the downhole environment information;

creating a polar graph with multiple stage type wedges to visually represent a time ordered sequence of fluid coverages or volumes of the downhole fluid treatment plan; and displaying a polar graph ring and a directional indicator with the polar graph, wherein the polar graph ring identifies when a stage type wedge of the polar graph is selected by a user, and wherein the directional indicator indicates order.

2. The downhole fluid treatment planning method of claim 1, wherein the received downhole environment information comprises wellbore dimension information for a wellbore, and reservoir layer information associated with the wellbore.

3. The downhole fluid treatment planning method of claim 1, wherein creating the polar graph comprises determining a wedge angle size for each the multiple stage type wedges of the polar graph, wherein each of the wedge angle sizes represents a percentage of total fluid coverage or volume for the fluid treatment plan.

4. The downhole fluid treatment planning method of claim 1, wherein creating the polar graph further comprises determining a wedge radius size for each of the multiple stage type wedges, wherein each of the wedge radius sizes represents coverage or volume value.

5. The downhole fluid treatment planning method of claim 4, wherein determining the wedge radius size for said each of the multiple stage type wedges, wherein said each of the wedge radius sizes represents coverage or volume value further comprises determining a variable wedge radius size for said each of the multiple stage type wedges, wherein said each of the wedge radius sizes represents coverage or volume, and wherein the variable wedge radius size may be varied based on user control.

6. The downhole fluid treatment planning method of claim 1, further comprising determining a total score, a material score, or a volume score for the downhole fluid treatment plan and displaying the total score, the material score, or the volume score with the polar graph.

7. The downhole fluid treatment planning method of claim 6, wherein determining the total score, the material score, or the volume score for the downhole fluid treatment plan and displaying the total score, the material score, or the volume score with the polar graph further comprises determining a score for each displayed stage type, state fluid, or additive, and distinguishing visually any wedge, stage fluid, or additive displayed having a sub-optimal score.

8. The downhole fluid treatment planning method of claim 7, further comprising updating the polar graph based on user wedge boundary dragging operations on stage type wedges of the polar graph, and displaying updated dimensions and colors of the polar graph as well as an updated score for the downhole fluid treatment plan as the polar graph is updated.

9. The downhole fluid treatment planning method of claim 1, further comprising receiving a pump schedule, wherein the downhole fluid treatment plan and the polar graph are based on the pump schedule.

10. The downhole fluid treatment planning method of claim 1, further comprising displaying a stage details window with the polar graph, wherein the stage details window provides stage type information, fluid information, and additive information upon selection of a stage type wedge of the polar graph.

11. A system for downhole fluid treatment planning comprises:

a memory having software;

an output device; and a processor coupled to the memory to execute the software, wherein the software configures the processor to:

receive downhole environment information;

generate a downhole fluid treatment plan based on the downhole environment information; and output a polar graph with multiple stage type wedges to visually represent a time ordered sequence of fluid coverages or volumes of the downhole fluid treatment plan; and displaying on the output device a polar graph ring and a directional indicator with the polar graph, wherein the polar graph ring identifies when a stage type wedge of the polar graph is selected by a user, and wherein the directional indicator indicates order.

12. The system of claim 11, wherein the software further configures the processor to determine a wedge angle size for the multiple wedges of the polar graph, wherein each of the wedge angle sizes represents a percentage of total fluid coverages or volumes for the fluid treatment plan.

13. The system of claim 11, wherein the software further configures the processor to determine a wedge radius size for the multiple wedges of the polar graph, wherein each of the wedge radius sizes represents a coverage or volume value.

14. The system of claim 11, wherein the software further configures the processor to determine a wedge color for the multiple wedges of the polar graph, wherein each of the wedge colors represents a specific stage type.

15. The system of claim 11, wherein the software further configures the processor to dynamically update dimensions and colors of the stage type wedges based on edit treatment interface selections.

16. The system of claim 11, wherein the software further configures the processor to generate a new polar graph based on new treatment interface that enables selection or modification of polar graph templates.

17. The system of claim 16, wherein the software further configures the processor to display the polar graph and to respond to selection of one of the stage type wedges by displaying a stage details window with stage type information, fluid information, recommended additive information, or other treatment stage type information.

18. The system of claim 11, wherein the software further configures the processor to determine a total score, a material score, or a volume score for the downhole fluid treatment plan and display the total score, the material score, or the volume score with the polar graph.

19. The system of claim 18, wherein the software further configures the processor to determine a score for each displayed stage type, state fluid, or additive, and distinguish visually any displayed wedge, stage fluid, or additive with a sub-optimal score.

20. The system of claim 19, wherein the software further configures the processor to updating the polar graph based on user wedge boundary dragging operations on stage type wedges of the polar graph, and display updated dimensions and colors of the polar graph as well as an updated score for the downhole fluid treatment plan as the polar graph is updated.

* * * * *